United States Patent [19]

Ferdi

[11] Patent Number: 4,852,931

[45] Date of Patent: Aug. 1, 1989

[54] SKI AND POLE CARRIER

[76] Inventor: Allan W. Ferdi, 2207 Zollinger Rd., Columbus, Ohio 43221

[21] Appl. No.: 264,812

[22] Filed: Oct. 31, 1988

[51] Int. Cl.[4] ..... A63C 11/02

[52] U.S. Cl. ..... 294;147; 224/917; 280/814

[58] Field of Search ..... 224/917; 294/147, 31.2; 280/809, 814

[56] References Cited

U.S. PATENT DOCUMENTS

| | | | |
|---|---|---|---|
| 3,262,619 | 7/1966 | Selnes | 294/147 |
| 3,994,048 | 11/1976 | Rosenthal | 294/147 X |
| 4,470,528 | 9/1984 | Dyess | 280/814 |
| 4,553,779 | 11/1985 | Shortridge | 294/147 |
| 4,630,842 | 12/1986 | Roda | 280/814 |
| 4,715,416 | 12/1987 | Horne | 280/814 X |

FOREIGN PATENT DOCUMENTS

| | | | |
|---|---|---|---|
| 7906337 | 2/1981 | Netherlands | 280/814 |
| 137188 | 9/1952 | Sweden | 294/147 |
| 158859 | 2/1933 | Switzerland | 280/814 |

*Primary Examiner*—Charles A. Marmor
*Assistant Examiner*—Michael Mar
*Attorney, Agent, or Firm*—Thomas S. Baker, Jr.

[57] ABSTRACT

A lightweight stowable ski and pole carrier for a pair of skis and a pair of ski poles which clamps the skis together and engages the ski poles to enable a carrier to carry the assemblage with one hand and with the skis extending parallel to the body of the skiers and the ski poles extending at an acute angle with respect to the skis.

19 Claims, 2 Drawing Sheets

SKI AND POLE CARRIER

BACKGROUND OF THE INVENTION

Snow skis and poles are cumbersome items to carry together because of their length and because four (4) separate items must be carried together. The traditional method of transporting skis and poles involves placing the running surfaces of the skis together and balancing the skis in a horizontal position on one shoulder with one hand and using the opposite hand to carry the ski poles. Several problems arise in connection with this method of carrying these items. To begin with lifting the skis and attempting to balance them on a shoulder with one hand and thereafter picking up the ski poles to carry them with the other hand involves some inconvenient and difficult movements. In some cases a skier may require assistance in order to get the skis balanced on one shoulder with one hand and to pick up and carry the poles with the opposite hand. Additionally, after use these skis may be dirty and carrying them on one's shoulder may cause the carrier's garment to become soiled. Furthermore, because the skis are carried in a horizontal position the possibility exists that the skis or poles may be caused to strike inadvertently another person.

When a skier has to remain in one position for a period of time such as in some type of line for a ski ticket or a chair or gondola lift, the skis commonly are held in a vertical position with one end resting on the ground with one hand and the ski poles are held in a vertical position with one end resting on the ground with the other hand. In other words, both of the skier's hands are required to handle his equipment. Obviously, this makes it difficult for the skier to handle a ticket, to remove or adjust an article of clothing or to do anything other than attend to his equipment.

Some devices have been developed to enable a skier to carry his skis and poles with one hand. Two (2) disadvantages reside in such devices. The first disadvantage resides in the fact that the devices are somewhat bulky and require a place for storage during the time the skier utilizes his equipment for skiing. Additionally, such devices generally require the skier to carry the skis and poles in a horizontal position which gives rise to the danger that a fellow skier or other person may be struck accidentally by the skis or poles.

One apparatus presently available which enables a skier to carry his skis and poles with one hand with the skis in a vertical position may be found in U.S. Pat. No. 4,630,842 to Roda. In the Roda structure a ski tip receiver defining a cylindrical opening is mounted fixedly on each ski. The axes of the cylindrical openings extend in a direction perpendicular to the longitudinal axis of the skis and are adapted to receive the tips of the ski poles. Accordingly, when the tips of the ski poles have been inserted into the cylindrical openings the ski poles project in a direction perpendicular to that of the skis. Thus, the ski poles may rest upon the skier's shoulders to permit the skis to maintain a vertical position behind him. A disadvantage of the Roda device resides in the fact that the ski poles must project in a horizontal direction which make them somewhat difficult to manage in a crowded surrounding. Additionally, the skier must grip the poles firmly together in order to prevent the skis from separating. Furthermore, nothing retains the poles within the cylinders giving rise to the possibility that a ski may slip off the end of a pole and be lost or strike someone.

It would be desirable to provide a ski and pole carrier for a pair of skis and a pair of ski poles which could be stored easily and preferably on the person of the skier at all times and which would enable the skier to carry the skis and poles in one hand. Additionally, it would be desirable to provide a ski and pole carrier which would enable the skier to carry the skis in a vertical position close to his body and to carry the poles at an acute angle with respect to the skis so that they would not project horizontally from the body of the skier. Additionally, it would be preferable to provide a ski and pole carrier which would clamp the skis together without additional effort on the part of the skier.

SUMMARY OF THE INVENTION

This invention provides a ski and pole carrier for a pair of skis having toe clips and a pair of ski poles having a vertical body member, a horizontally extending upper ski loop means attached to one end of the vertical body member for clamping the pair of skis together above the toe clips, a horizontally extending lower ski loop means attached to the other end of the body member for engaging the skis below the toe clips to support the weight thereof and a pole loop means attached to the body member for receiving and clamping the poles together.

DESCRIPTION OF THE PREFERRED EMBODIMENT

Figure 1:
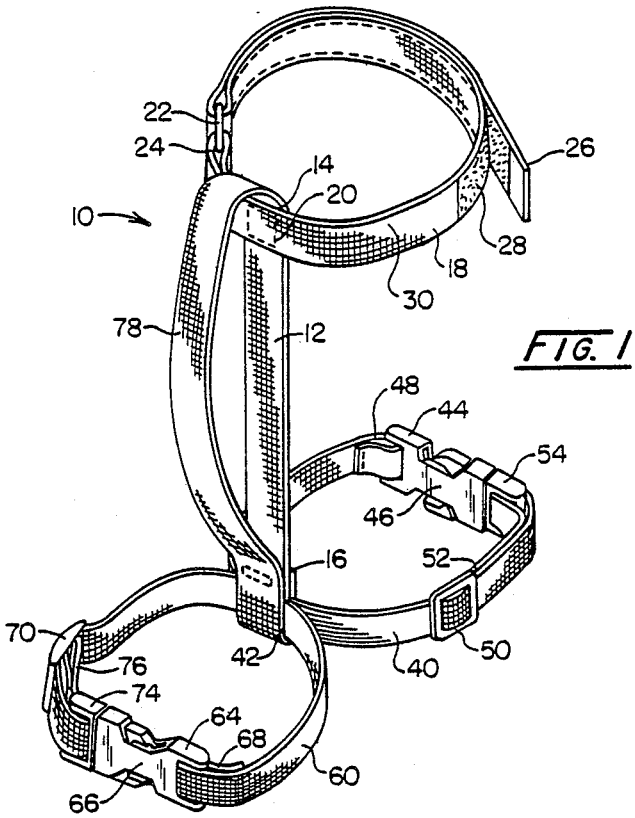
FIG. 1 is a perspective view of the ski and pole carrier of the present invention.

Referring to FIG. 1 of the drawing, the ski and pole carrier (10) of the present invention may be seen to include a generally vertically extending body member (12) having one end which may be designated an upper end (14) and an other end which may be designated a lower end (16). An upper ski loop (18) projects laterally from the upper end (14) of body member (12). Upper ski loop (18) may be constructed from a single strip of nylon material which may be rigidly affixed to upper end (14) as by stitching (20). A D-ring (22) having a D-shape may be affixed to one end (24) of loop (18) to receive the other end (26) thereof to enable the diameter of the loop to vary. A hook and loop material fastener (28) attached to the outer surface (30) of loop (18) provides a means for maintaining a desired loop size. Additionally, upper ski loop (18) may be constructed from a strip of hook and loop fastener without the nylon.

A lower ski loop (40) preferably constructed of a single piece of nylon material passes through one side of a double loop (42) formed in the other end (26) of body member (12). Consequently, lower ski loop (40) projects horizontally and substantially perpendicular to body member (12) and may slide along its length through loop (42). The female element (44) of a side release buckle assembly (46) is received in a loop formed in one end (48) of lower ski loop (40) and a slidable strap adjuster (50) is retained in a loop formed at the other end (52) of ski loop (40). End (52) of ski loop (40) first passes through openings formed in the slidable strap adjuster (50) and through an opening formed in a male element (54) of side release buckle assembly (46) before being anchored to the central portion of strap adjuster (50). In this manner the length of the lower ski loop (40) having the male element (54) may be adjusted to accommodate different sizes of skis.

A pole loop (60) which is identical in construction with lower ski loop (40) passes through the other side of loop (42) formed in the other end (26) of body member (12). Consequently, pole loop (60) also may slide through loop (42) in the same manner as lower ski loop (40). A female element (64) of a side release buckle assembly (66) is retained in a loop formed in one end (68) of pole loop (60). The opposite end of pole loop (60) passes through openings formed in a slidable strap adjuster (70), through an opening formed in a male element (74) of side release buckle assembly (68) and forms an outer loop (76) at its other end which captures slidable strap adjuster (70). Again, this arrangement permits the length of pole loop (60) at male element (74) to be adjusted to change the opening of pole loop (60).

Turning again to FIG. 1, it may be observed that body member (12) comprises a single piece of material preferable nylon having a double loop (42) at one end and a handle element (78) which extends between the upper and lower ski loops (18) and (40) parallel to body member (12).

From the above, it may be seen that the upper and lower ski loops (18) and (40) and pole loop (60) each may be formed from a single piece of material such as nylon or hook and loop fastener. Additionally, body member (12) and handle (78) may be constructed from a single piece of nylon material. Use of such material makes the ski and pole carrier of the present invention lightweight and easily stowable on the body of a skier. These pieces of material each may have a different color to aid in identifying the particular loops.

Figure 2:
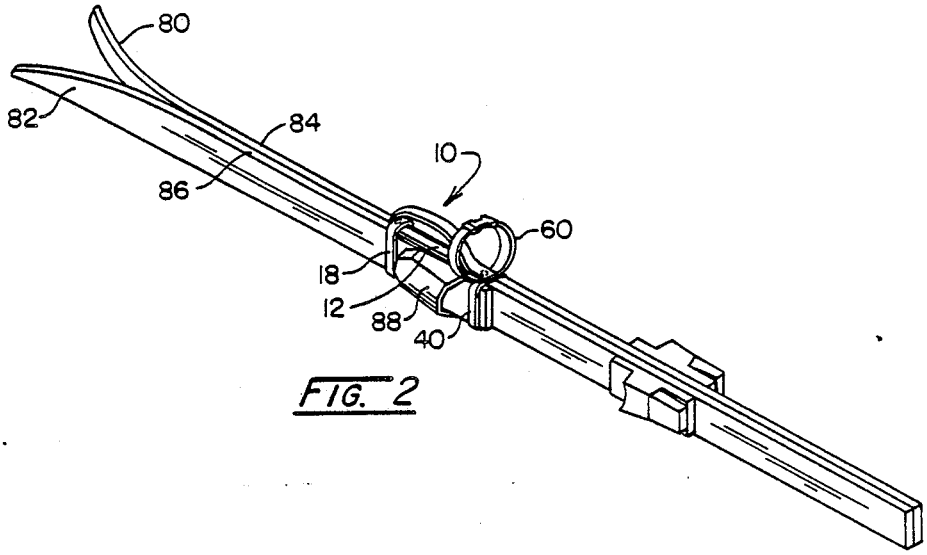
FIG. 2 is a view of the ski and pole carrier having the upper and lower ski loops wrapped around a pair of skis.
Figure 3:
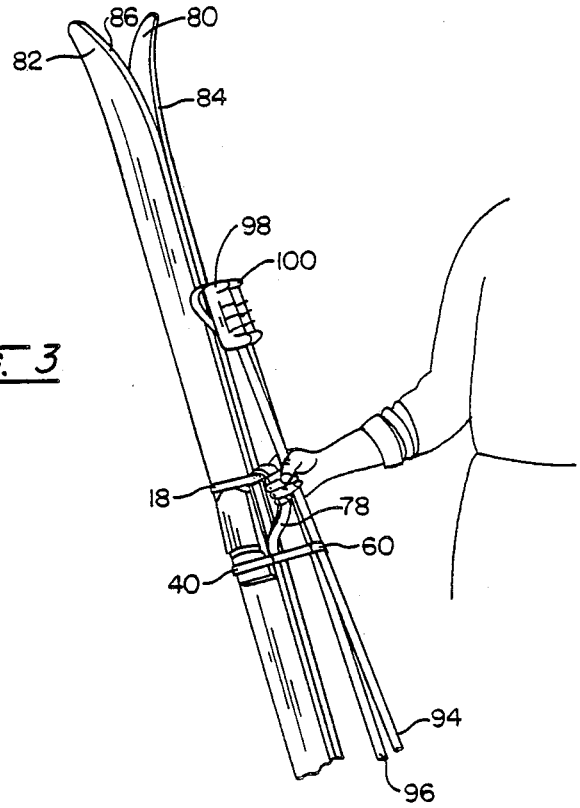
FIG. 3 is a view of the ski and pole carrier of the present invention securing a pair of skis and a pair of poles in a manner which enables these items to be carried by a person using one hand and gripping a handle member on the carrier.
Figure 4:
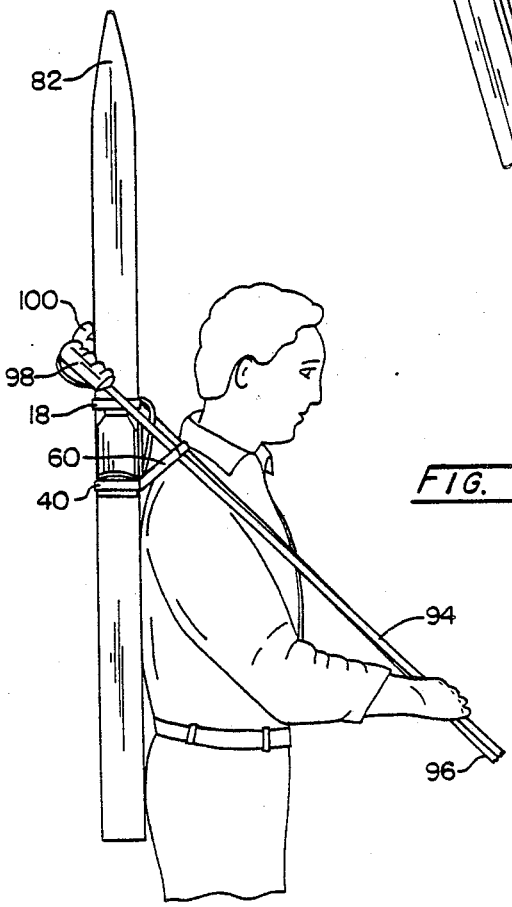
FIG. 4 is a view of the ski and pole carrier of the present invention attached to a pair of skis and a pair of poles all of which are being carried by a person.

Use of the ski and pole carrier (10) of the present invention may be seen by referring first to FIG. 2 for installation of the device on a pair of skis and thereafter to FIG. 4 for installation on a pair of poles. Turning to FIG. 2, prior to installation of the ski and pole carrier (10) the skis (80 and 82) are placed with their running surfaces in abutment. Thereafter the ski and pole carrier (10) is placed with the body member (12) against the sides (84) and (86) of the skis (80 and 82) adjacent the toe clips (88) one of which is shown. Thereafter, the upper ski loop (18) is wrapped around both skis (80 and 82) just above the toe clip (88) and secured by the hook and loop fastener (28) which may be the material trademarked Velcro tightly securing the skis together. Subsequently, the lower ski loop (60) is wrapped around the skis (80 and 82) just below the toe clips (88). At this time, the length of the end (52) carrying male element (54) of side release buckle assembly (46) may be adjusted to remove unnecessary slack from the lower ski loop and to cause the lower ski loop (40) to carry the weight of the skis. Further adjustment of buckle assembly (46) may be necessary to cause lower ski loop (40) to act in combination with pole loop (60) to properly limit the rotation of the poles relative to the skis as discussed more completely hereinbelow.

From the above it may be seen that installation of the upper ski loop (18) and the lower ski loop (40) on the pair of skis (80 and 82) tightly clamps the skis together. Additionally, because the upper and lower ski loops (18 and 40) are on opposite sides of the toe clips (88) the ski and pole carrier (10) cannot slide longitudinally along the skis (80 and 82).

Subsequent to installation of the pole carrier (10) on the skis (80 and 82) the ski poles (94 and 96) are placed parallel to the sides (84 and 86) of the skis (80 and 82) and the pole loop (60) is wrapped around the poles some distance below their handles (98 and 100). The slidable strap adjuster (70) may be utilized to adjust the length of the end containing the male element (74) of the side release buckle assembly (66). This length should be adjusted such that the ski poles (94 and 96) may pivot or rotate no more than approximately 90 degrees with respect to the skis. When the skis are rotated one handle (94) should pass over the top surface of one ski (82) and the other handle (100) should pass over the top surface of the ski (80). In this manner the ski poles (94 and 96) also tend to prevent the skis (80 and 82) from rotating about body member (12). When the ski poles (94 and 96) are at a 90 degree angle with respect to the skis (80 and 82) the skier or other person carrying these elements may grasp the poles with both hands and raise the assemblage such that the skis assume a vertical position immediately behind his body and the poles extend over his shoulder. Thereafter, the poles (94 and 96) may be rotated clockwise or downwardly such that they project at an acute angle with respect to the skis (80 and 82) and do not project perpendicular to the skis. This reduces the possibility that the pointed ends of the poles (94 and 96) may strike someone and provides for a more comfortable carrying position.

Turning to FIG. 4, it may be seen that the ski and pole carrier (10) of the present invention also enables a skier or other person to carry the skis (80 and 82) and the poles (94 and 96) to be carried in one hand and parallel to each other. Such a position would be useful when the skier is in a confined area or in a very crowded area. In this position, the skier places his hand around the skis (94 and 96) and the handle (78). Because the handle (78) is rigidly affixed to the upper and lower ski loops (18 and 40) grasping the handle (78) provides control for the skis (80 and 82) as well as for the ski poles (94 and 96).

Since certain changes may be made to the above described ski and pole carrier without departing from the scope of the invention herein it is intended that all matter contained in the description thereof or shown in the accompanying drawings shall be interpreted as illustrative and not in a limiting sense.

I claim:

1. A ski and pole carrier for a pair of skis having toe clips and a pair of ski poles which comprises:

an elongated vertical body member;

a releasable, horizontally extending upper ski loop means for releasably clamping the pair of skis together immediately above said toe clips;

said upper ski loop means being attached to one end of said body member;

a releasable horizontally extending lower ski loop means for releasably engaging the skis immediately below said toe clips to support the weight thereof to thereby enable a user to transport said skis in a vertical orientation with said carrier;

said lower ski loop means being attached to the other end of said body member;

a pole loop means attached to said body member for receiving and clamping said pair of poles together;

said pole loop means extending from said body member on the side opposite that from which said upper and lower ski loop means extends;

a handle means attached to said body member;

wherein one and of said handle means is attached to one end of said body member and the other end of said handle means is attached to the other end of said body member such that said handle means extends parallel to said body member to enable one to simultaneously grasp said handle means and a pair of poles such that said poles extend in a direction parallel to said skis.

2. The ski and pole carrier of claim 1 further comprising pivotal attachment means for pivotally attaching said pole loop to said body member to enable said ski poles to assume an acute angle with respect to said skis when said skis and poles are transported by a user extending said poles over his shoulder such that the poles extend through said pole loop means when utilizing said ski and pole carrier to transport said skis.

3. The ski and pole carrier of claim 1, in which;

said upper ski loop means includes adjustment means for adjusting the length of said loop means to accommodate skis of different sizes.

4. The ski and pole carrier of claim 1, in which;

said upper ski loop adjustment means includes a loop and hook fastening tape.

5. The ski and pole carrier of claim 1, in which;

said lower ski loop means includes adjustment means for adjusting the length of said loop means to accommodate skis of different sizes.

6. The ski and pole carrier of claim 5, in which; said lower ski loop adjustment means includes a sliding releasable buckle to adjust the length of said loop means to accommodate skis of different sizes.

7. The ski and pole carrier of claim 1, in which;

said pole loop includes adjustment means for adjusting the length of said pole loop to provide proper rotation of the poles with respect to the skis.

8. The ski and pole carrier of claim 7, in which;

said pole loop adjustment means includes a releasable sliding buckle to adjust the length of said loop means to provide proper rotation of the poles with respect to the skis.

9. The ski and pole carrier of claim 1, in which;

at least one of said upper and lower ski loops is constructed of nylon material.

10. The ski and pole carrier of claim 1, in which;

both of said upper and lower ski loops is constructed of nylon material.

11. The ski and pole carrier of claim 10, in which; said pole loop is constructed of nylon material.

12. The ski and pole carrier of claim 1, in which;

said pole loop means is adapted to receive a pair of ski poles which have been positioned one on each side of said skis when in use.

13. The ski and pole carrier of claim 1, in which;

each of said upper and lower ski loop means are different colors.

14. The ski and pole carrier of claim 13, in which:

said pole loop means has a different color than either of said upper and lower ski loop means.

15. The ski and pole carrier of claim 1, in which;

said lower ski loop means and said pole loop means pass through an end loop formed on the other end of said body member for slidable attachment thereto.

16. The ski and pole carrier of claim 15, in which;

said end loop is a double loop to prevent said lower ski loop means and said pole loop means of changing position.

17. The foldable ski and pole carrier of claim 1, in which;

said pole loop means and said handle are formed from a single continuous piece of material.

18. A method of carrying a pair of skis having toe clips and a pair of ski poles utilizing a ski and pole carrier having a vertical body member, a horizontally extending upper ski loop means for clamping the pair of skis together above said toe clips, said upper ski loop means being attached to one end of said body member, a horizontally extending lower ski loop means for supporting the pair of skis below said toe clips, said lower ski loop means being attached to the other end of said body member and a pole loop means attached to said body member for clamping said pair of poles together which comprises the steps of:

placing said upper ski loop means around the skis above the toe clamps and securing said upper ski loop means in that position;

placing said lower ski loop means around the skis below the toe clamps and securing said lower ski loop means in that position;

placing said pole loop means around the poles and securing said pole loop means such that the poles may be rotated relative to the skis to where each of the pole handles rest on a person's shoulder and each pole handle overlies the top surface of a ski and the skis extend in a vertical direction parallel to the user's body behind the user and the poles project forwardly of the user at an acute angle with respect to the skis.

19. A method of carrying a pair of skis having toe clips and a pair of ski poles vertically in one hand of a user utilizing a ski and pole carrier having a vertical body member, a horizontally extending upper ski loop means for clamping the pair of skis together above said toe clips, said upper ski loop means being attached to one end of said body member, a horizontally extending lower ski loop means for supporting the pair of skis below said toe clips, said lower ski loop means being attached to the other end of said body member, a handle member affixed to said body member and extending parallel thereto and a pole loop means attached to said body member for clamping said pair of poles together which comprises the steps of:

placing said upper ski loop means around the skis above the toe clamps and securing said upper ski loop means in that position;

placing said lower ski loop means around the skis below the toe clamps and securing said lower ski loop means in that position;

placing said pole loop means around the poles and securing said pole loop means such that the poles may be rotated to extend parallel to the skis to enable the user to simultaneously grasp said handle means and said poles in one hand to thereby carry said skis and poles in a vertical position in that hand.

* * * * *